US010845061B2

(12) United States Patent
Streitwieser et al.

(10) Patent No.: US 10,845,061 B2
(45) Date of Patent: Nov. 24, 2020

(54) HOUSEHOLD COOKING APPLIANCE

(71) Applicant: BSH Hausgeräte GmbH, Munich (DE)

(72) Inventors: Katrin Streitwieser, Waging am See (DE); Maximilian Bernauer, Kienberg (DE)

(73) Assignee: BSH Hausgeräte GmbH, Munich (DE)

( * ) Notice: Subject to any disclaimer, the term of this patent is extended or adjusted under 35 U.S.C. 154(b) by 76 days.

(21) Appl. No.: 16/320,561

(22) PCT Filed: Nov. 24, 2017

(86) PCT No.: PCT/EP2017/080357
§ 371 (c)(1),
(2) Date: Jan. 25, 2019

(87) PCT Pub. No.: WO2018/108483
PCT Pub. Date: Jun. 21, 2018

(65) Prior Publication Data

US 2019/0242588 A1 Aug. 8, 2019

(30) Foreign Application Priority Data

Dec. 12, 2016 (DE) ..... 10 2016 224 757

(51) Int. Cl.
*F24C 15/02* (2006.01)
*F24C 15/04* (2006.01)

(52) U.S. Cl.
CPC ..... *F24C 15/021* (2013.01); *F24C 15/04* (2013.01)

(58) Field of Classification Search
CPC ..... F24C 15/021; F24C 15/04; F24C 15/045; E06B 3/02; E06B 3/025; E06B 3/5892; E06B 7/16; B60J 10/70
See application file for complete search history.

(56) References Cited

U.S. PATENT DOCUMENTS 3,200,812 A * 8/1965 Larkin ..... F24C 15/021 126/200
3,244,165 A * 4/1966 Buck ..... F24C 15/021 126/200
5,588,421 A * 12/1996 Busch ..... F24C 15/04 126/190

(Continued)

FOREIGN PATENT DOCUMENTS

DE 29503872 U1 8/1996
DE 10138889 A1 3/2003

(Continued)

OTHER PUBLICATIONS

International Search Report PCT/EP2017/080357 dated Mar. 13, 2018.
National Search Report DE 10 2016 224 757.3 dated Mar. 6, 2018.

*Primary Examiner* — David J Laux
(74) *Attorney, Agent, or Firm* — Michael E. Tschupp; Andre Pallapies; Brandon G. Braun

(57) ABSTRACT

A household cooking appliance includes a cooking chamber and a door for closing the cooking chamber. The door includes a first pane, a second pane arranged at a spacing from the first pane, a first door profile, a second door profile arranged at a spacing from the first door profile, and a sealing device arranged between the first pane and the second pane and fastened to the first door profile and the second door profile.

10 Claims, 7 Drawing Sheets

(56) References Cited

U.S. PATENT DOCUMENTS

| | | | | |
|---|---|---|---|---|
| 2005/0003116 | A1* | 1/2005 | Demars | E06B 3/6621 428/34 |
| 2006/0048468 | A1* | 3/2006 | Demars | F24C 15/04 52/204.6 |

FOREIGN PATENT DOCUMENTS

| | | | |
|---|---|---|---|
| DE | 10314214 | A1 | 10/2004 |
| DE | 102011088073 | A1 | 6/2013 |
| DE | 102011088082 | A1 | 6/2013 |
| DE | 102015108618 | A1 | 12/2016 |
| EP | 1867927 | A2 | 12/2007 |
| WO | 2015165499 | A1 | 11/2015 |

* cited by examiner

HOUSEHOLD COOKING APPLIANCE

CROSS-REFERENCES TO RELATED APPLICATIONS

This application is the U.S. National Stage of International Application No. PCT/EP2017/080357, filed Nov. 24, 2017, which designated the United States and has been published as International Publication No. WO 2018/108483 A1 and which claims the priority of German Patent Application, Serial No. 10 2016 224 757.3, filed Dec. 12, 2016, pursuant to 35 U.S.C. 119(a)-(d).

BACKGROUND OF THE INVENTION

The present invention relates to a household cooking appliance.

A household cooking appliance, in particular an oven, may have a heatable cooking chamber. The cooking chamber may be closable with the aid of a door. The door may have a plurality of panes that are arranged parallel to one another and at a spacing from one another and are positioned relative to one another with the aid of door profiles. Sealing elements may be provided between the panes.

DE 103 14 214 A1 discloses an oven door for closing an oven inner lining having a multiple-pane arrangement, comprising at least an inner pane, an intermediate pane and an outer pane, wherein an air ingress opening is provided in the lower door region and an air egress opening is provided in the upper door region, these being in communication with the intermediate spaces between the panes of the oven door. A sealing element running transversely to the panes may be provided in the first intermediate space between the inner pane and the intermediate pane, in order to prevent an air flow from the air ingress opening to the air egress opening via the first intermediate space.

DE 10 2011 088 082 A1 describes a door for a household cooking appliance, having a first pane, a second pane that is arranged at a spacing from the first pane, and at least one sealing element arranged between the panes, wherein the sealing element is an elongate component that takes a form that is open in cross section and has a non-rectilinear cross sectional contour, wherein the sealing element takes a form that is reversibly deformable in the cross sectional plane in at least one direction.

BRIEF SUMMARY OF THE INVENTION

Given this background, an object of the present invention is to provide an improved household cooking appliance.

Accordingly, a household cooking appliance having a cooking chamber and a door for closing the cooking chamber is proposed. Here, the door includes a first pane, a second pane arranged at a spacing from the first pane, a first door profile, a second door profile arranged at a spacing from the first door profile, and a sealing device that is arranged between the first pane and the second pane and is fastened to the first door profile and the second door profile.

Because the sealing device is fastened directly to the door profiles, it is possible to dispense with fastening the sealing device directly to one of the panes. This makes simplified assembly and disassembly possible. This enables both simplified manufacture of the household cooking appliance and also simplified cleaning by customers, since the sealing device can be detached in a simple manner. Furthermore, because the sealing device is not fastened directly to one of the panes, the possibility of one of the panes or both panes being damaged is avoided.

Preferably, the door includes a plurality of panes. For example, the door may include four panes. The panes may be made for example from a glass material and be transparent, at least in certain regions. In particular, the door may include the first pane, the second pane, which is arranged at a spacing from and parallel to the first pane, a third pane that is arranged at a spacing from and parallel to the second pane, and a fourth pane that is arranged parallel to the and at a spacing from the third pane. Here, the fourth pane may be designated the outer pane or front pane. The first pane may be designated the inner pane. The second and third panes may each be designated an intermediate pane. A gap is provided in each case between the panes. For example, a first gap in which the sealing device is arranged is provided between the first pane and the second pane. A second gap is provided between the second pane and the third pane, and a third gap is provided between the third pane and the fourth pane.

Preferably, the door profiles are fastened on an inner side of the fourth pane, for example being bonded thereto by adhesion. The door profiles may be made for example from a plastics material or a metal material. The panes are positionable in relation to one another with the aid of the door profiles. For this purpose, the panes are at least partly received in receiving portions of the door profiles. The panes may be positioned at defined spacings from one another with the aid of the door profiles. For example, the door profiles are arranged at least in certain regions between the first pane and the second pane. In the present document, the term "in certain regions" should be understood to mean that the door profiles are not arranged entirely, but only partly, between the first pane and the second pane. The door may have a plurality of these sealing devices, which may also be arranged in the second gap and/or the third gap. As an alternative, there may also be no sealing devices of this kind in the second gap and/or in the third gap, as a result of which air circulation is possible in these gaps. The sealing device is provided in a lower region or on a lower edge of the door.

According to one embodiment, the sealing device is connected form-fittingly to the first door profile and the second door profile.

A form-fitting connection is produced when at least two connected parts, in this case the sealing device and the door profiles, engage in or behind one another. As a result of the form-fitting connection, the sealing device may easily be separated from the door profiles and connected to them again. This makes it possible for assembly and disassembly to be particularly simple. It is possible to dispense with a form-fitting connection or substance-to-substance bond between the sealing device and one of the panes.

According to a further embodiment, the sealing device is suspended in the first door profile and the second door profile.

This makes it possible for the sealing device to be mounted and detached particularly simply. In particular, this makes it possible for the sealing to be mounted and detached without tools.

According to a further embodiment, the sealing device is suspended in the first door profile and the second door profile in a pretensioned manner.

This should be understood to mean that when the sealing device is mounted it is put resiliently under tension, and this tension is always maintained, even after the sealing device has been mounted. With the aid of the pretensioning, sagging of the sealing device can be reliably prevented. This ensures optimum positioning of the sealing device.

According to a further embodiment, the sealing device has a first suspension hook for suspending the sealing device in the first door profile, and a second suspension hook for suspending the sealing device in the second door profile.

Preferably, each suspension hook has a connection portion that is firmly connected to a sealing element of the sealing device. Further, each suspension hook includes a hooking portion that is intended to engage form-fittingly in the respective door profile. Preferably, an intermediate portion is provided between the hooking portion and the connection portion. Thus, each suspension hook has a C-shaped geometry.

According to a further embodiment, the sealing device has a resiliently deformable sealing element that is arranged between the first suspension hook and the second suspension hook and is firmly connected thereto.

For example, the sealing element may be connected to the suspension hooks form-fittingly and/or in a substance-to-substance bond. For example, the sealing element may be bonded to the suspension hooks by adhesion. As an alternative, the sealing element may also be connected to the suspension hooks in one piece, that is to say materially in one part. In this case, the sealing element is preferably made from the same material as the suspension hooks.

According to a further embodiment, the first suspension hook and the second suspension hook are made from a steel material, and the sealing element is made from a silicone material.

As an alternative, any other desired materials may be used. For example, the suspension hooks may be made from a plastics material, steel sheet or a silicone material. The sealing element may likewise be made from another material, for example spring steel.

According to a further embodiment, the sealing element has sealing lips that are intended to abut sealingly against the first pane and/or the second pane.

Preferably, in cross section the sealing element has a hollow space. The sealing lips are in particular elastically deformable. In particular, the sealing element may have two sealing lips that are associated with the first pane and two sealing lips that are associated with the second pane.

According to a further embodiment, the first door profile and the second door profile each have a receiving portion, in particular an aperture, in which the sealing device is suspended.

The receiving portion may for example take the form of a rectangular aperture or a circular bored hole. The geometry of the receiving portion depends on the geometry of the suspension hooks. The receiving portion may in principle have any desired geometry. In particular, the respective hooking portion of the suspension hooks is guided through the receiving portion.

According to a further embodiment, the first door profile and the second door profile each have a groove portion in which the first suspension hook and the second suspension hook are laid.

Preferably, the connection portion of the suspension hooks is laid in the groove portion. As a result, the connection portion does not project beyond the door profile, as a result of which the respective pane may be laid flat against a surface of the door profiles. As a result, damage to or mechanical overload of the pane is avoided.

Further possible implementations of the household cooking appliance also include combinations of features or embodiments described above or below in respect of the exemplary embodiments which are not named explicitly. Here, those skilled in the art will also add individual aspects as improvements or additions to the respective basic form of the household cooking appliance.

BRIEF DESCRIPTION OF THE DRAWINGS

Further advantageous embodiments of the household cooking appliance form the subject matter of the subclaims and of the exemplary embodiments of the household cooking appliance that are described below. The household cooking appliance is explained in more detail below by way of preferred embodiments, with reference to the attached figures.

DETAILED DESCRIPTION OF EXEMPLARY EMBODIMENTS OF THE PRESENT INVENTION

Figure 1:
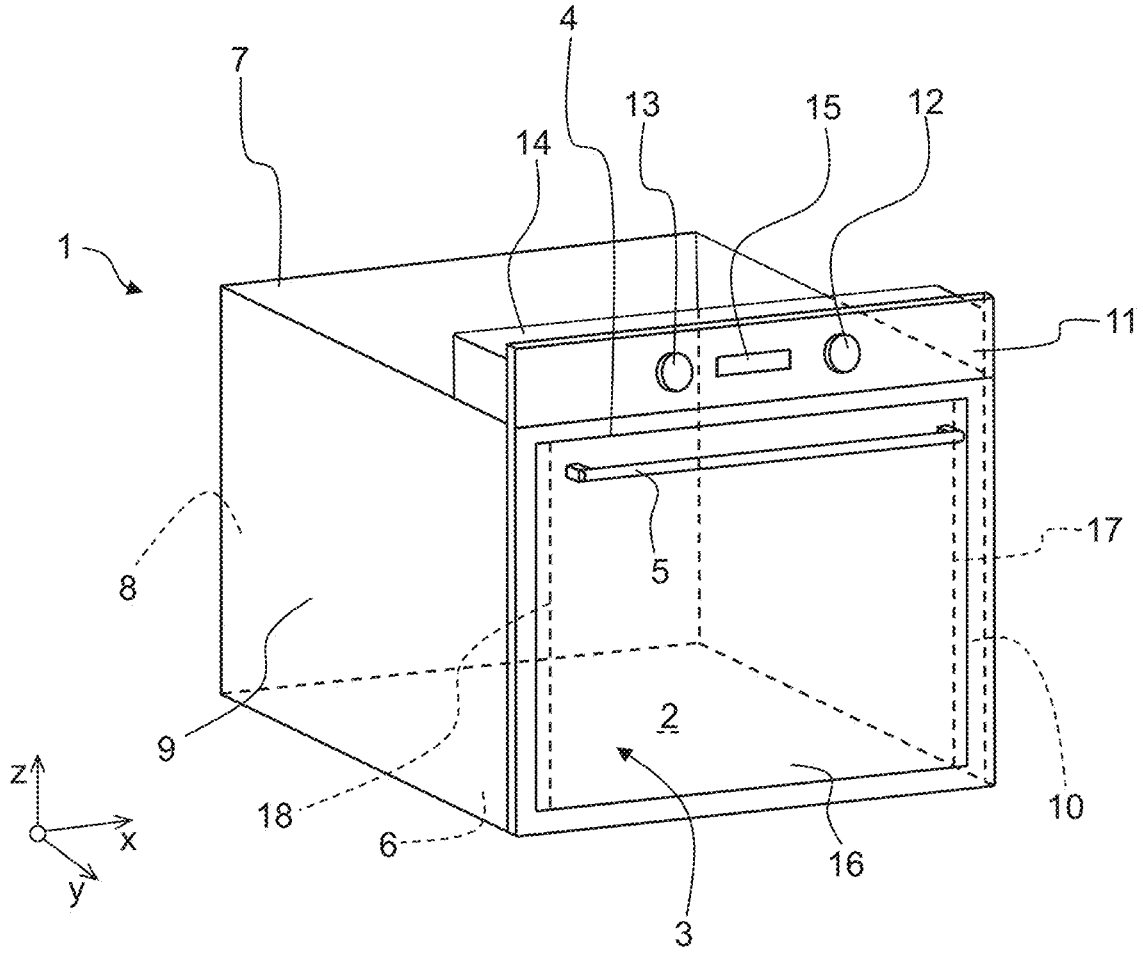
FIG. 1 shows a schematic perspective view of an embodiment of a household cooking appliance.

In the figures, like or functionally equivalent elements have been provided with the same reference characters unless indicated otherwise.

FIG. 1 shows a schematic perspective view of an embodiment of a household cooking appliance 1. The household cooking appliance 1 is preferably an oven, an oven with a steam cooking function, a combination microwave/conventional oven or similar. The household cooking appliance 1 has an oven inner lining, inner lining or cooking chamber 2 that is closable with the aid of a door 3. The cooking chamber 2 may be arranged in the interior of a housing of the household cooking appliance 1. In FIG. 1, the door 3 is illustrated in its closed position. By pivoting it about a pivot axis provided at a lower end of the door 3, the door 3 may be closed or opened. As an alternative, the door 3 may be brought laterally into abutment against the cooking chamber 2. Further, the door 3 may be arranged on an oven carriage that may be pulled out of the cooking chamber 2. A handle 5 may be arranged in an upper portion or at an upper edge 4 of the door 3.

The cooking chamber 2 has a base 6, a ceiling 7 arranged opposite the base 6, a rear wall 8 arranged opposite the closed door 3, and two side walls 9, 10 arranged opposite one another. The cooking chamber 2 is preferably cuboid or in the shape of a regular cube. The cooking chamber 2 may be made from a metal material, in particular steel sheet.

The household cooking appliance 1 further includes operating knobs 12, 13 provided on an operating panel 11. The operating knobs 12, 13 may be rotatable, for example. On the rear side of the operating panel 11 there may be provided a control device 14 (shown only schematically) for controlling the household cooking appliance 1. The control device 14 may be a closed-loop and/or open-loop control device.

Further, a display field 15 may be provided on the operating panel 11. An operating condition of the household cooking appliance 1 may be displayed with the aid of the display field 15. For example, with the aid of the display field 15 a temperature that has been set using the operating knobs 12, 13 may be displayed.

The door 3 has a plurality of panes 16, of which only one, namely a front pane, is shown in FIG. 1. Further, the door 3 includes a first door profile 17 and a second door profile 18 that are positioned at a spacing from one another and parallel to one another. The door profiles 17, 18 may be fastened on the rear side of the pane 16, that is to say facing the cooking chamber 2, in particular being bonded to the pane 16 by adhesion. In a closed condition of the door 3, the door profiles 17, 18 run in a Z direction z of the household cooking appliance 1. Further, FIG. 1 also shows an X direction x and a Y direction y of the household cooking appliance 1.

Figure 2:
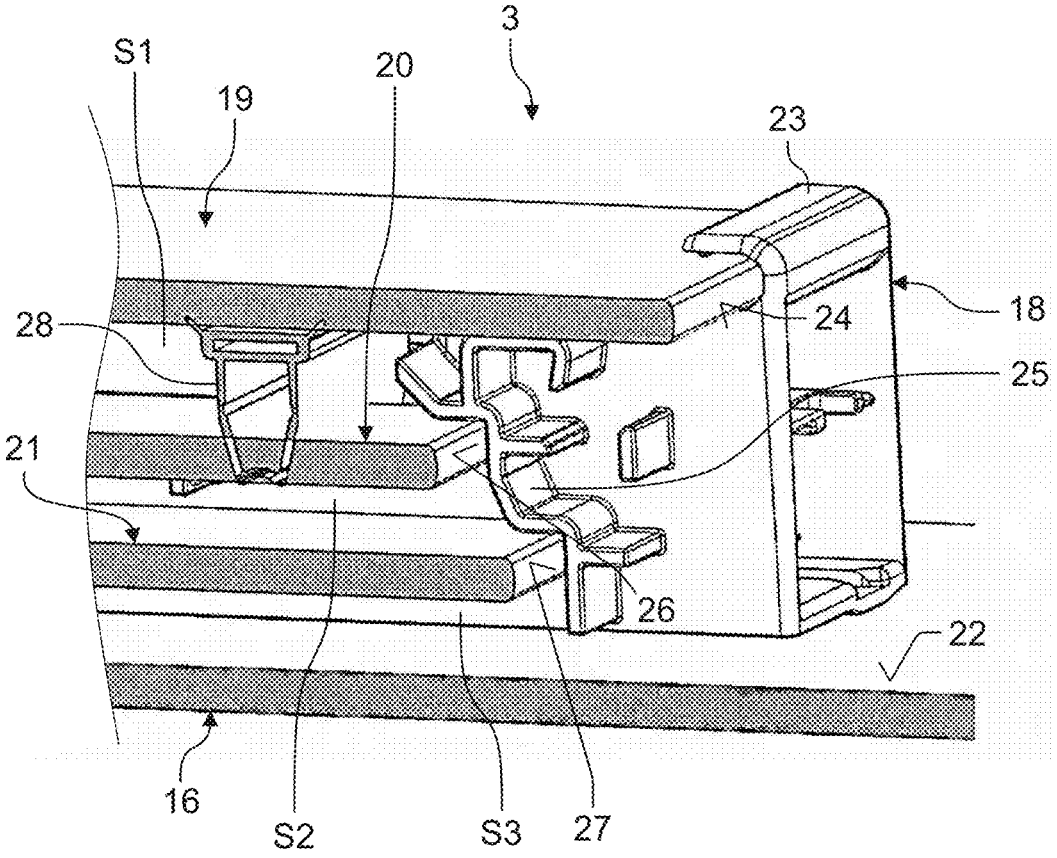
FIG. 2 shows a schematic partial sectional view of a door for the household cooking appliance according to FIG. 1.

FIG. 2 shows a schematic partial sectional view of the door 3. The door 3 includes a plurality of panes 16 and 19 to 21. The panes 16 and 19 to 21 may be made for example from a glass material, and are at least partly transparent. The pane 19 may also be designated the first pane or inner pane, the pane 20 may also be designated the second pane or the first intermediate pane, the pane 21 may also be designated the third pane or second inner pane, and the pane 16 may also be designated the fourth pane or front pane. The door profiles 17, 18 are preferably firmly connected to an inner face 22 of the pane 16, for example being bonded by adhesion.

Each door profile 17, 18 has a receiving portion 23 for receiving the first pane 19. The receiving portion 23 has for example a hook shape and can reach around an edge 24, in particular an upper edge or a lower edge, of the first pane 19, at least in certain regions. Each door profile 17, 18 further has a receiving portion 25 that is intended to position the second pane 20 and the third pane 21 in the door 3. For this purpose, an edge 26, in particular an upper edge or a lower edge, of the second pane 20 and an edge 27, in particular an upper edge or a lower edge, of the third pane 21 may abut against the receiving portion 25.

With the aid of the door profiles 17, 18, the panes 16 and 19 to 21 may be arranged parallel to one another and at a spacing from one another. Here, each pane 16 and 19 to 21 represents one level. In particular, the second pane 20 is arranged at a spacing from the first pane 19, the third pane 21 is arranged at a spacing from the second pane 20, and the fourth pane 16 is arranged at a spacing from the third pane 21. Here, the spacings between the panes 16 and 19 to 21 may be different or alike. Air can circulate between the panes 16 and 19 to 21. A first gap S1 is provided between the first pane 19 and the second pane 20, a second gap S2 is provided between the second pane 20 and the third pane 21, and a third gap S3 is provided between the third pane 21 and the fourth pane 16. The door profiles 17, 18 are arranged between the first pane 19 and the fourth pane 16. However, and also at least in certain regions, the door profiles 17, 18 are arranged between the first pane 19 and the second pane 20 and between the first pane 19 and the third pane 21.

The door 3 further includes a sealing device 28. As shown in FIG. 2, the sealing device 28 may be arranged in the first gap S1, between the first pane 19 and the second pane 20. As an alternative, the sealing device 28 may also be arranged between the second pane 20 and the third pane 21 or between the third pane 21 and the fourth pane 16. The sealing device 28 is fastened to both the first door profile 17 and the second door profile 18. In particular, the sealing device 28 is connected form-fittingly to the first door profile 17 and the second door profile 18. A form-fitting connection is produced when at least two connected parts, in this case the door profiles 17, 18 and the sealing device 28, engage in or behind one another. In particular, the sealing device 28 is suspended in the first door profile 17 and the second door profile 18. Here, the sealing device 28 may be suspended in the door profiles 17, 18 in a pretensioned manner.

Figure 3:
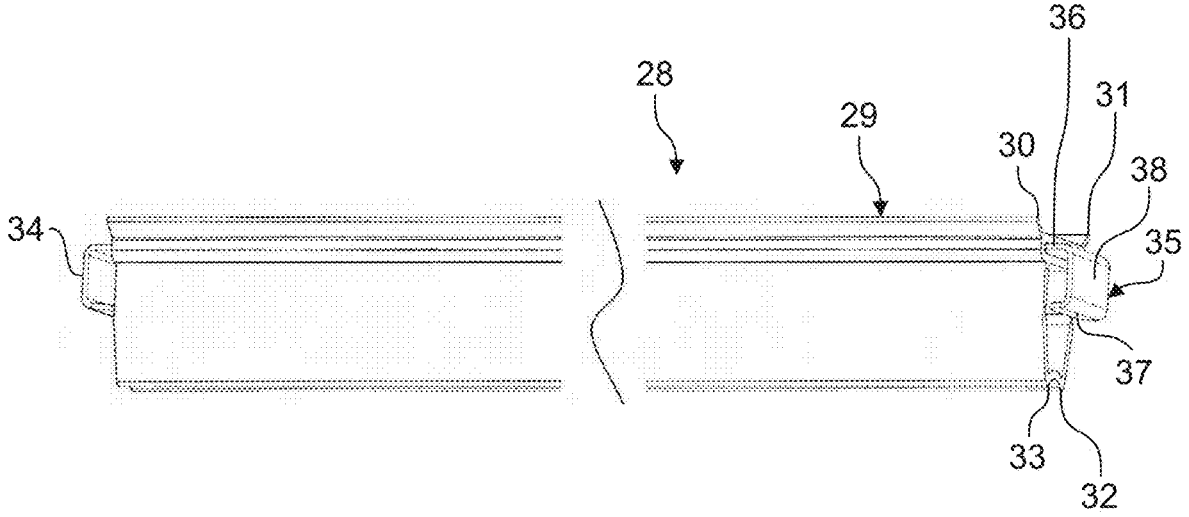
FIG. 3 shows a schematic perspective view of an embodiment of a sealing device for the door according to FIG. 2.

The sealing device 28 that is shown in FIG. 3 in a schematic perspective view includes a resiliently deformable sealing element 29 that is made for example from a silicone material. The sealing element 29 extends perpendicular to the door profiles 17, 18 and is positioned between them. The sealing element 29 may have any desired cross sectional geometry. For example, the sealing element 29 may take a hollow form, at least in certain regions. The sealing element 29 includes a plurality of sealing lips 30 to 33. Here, the sealing lips 30, 31 are intended to seal the sealing element 29 in relation to the first pane 19, and the sealing lips 32, 33 are intended to seal the sealing element 29 in relation to the second pane 20.

In addition to the sealing element 29, the sealing device 28 includes a first suspension hook 34 for suspending the sealing device 28 in the first door profile 17, and a second suspension hook 35 for suspending the sealing device 28 in the second door profile 18. Preferably, the suspension hooks 34, 35 are made from a steel material. The suspension hooks 34, 35 may be connected form-fittingly or in a substance-to-substance bond to the sealing element 29. In the case of substance-to-substance bonds, the connected parts are held together by atomic or molecular forces. Substance-to-substance bonds are non-detachable connections, which can only be severed by destroying the means of connection and/or the connected parts. For example, the suspension hooks 34, 35 are bonded to the sealing element 29 by adhesion. Each suspension hook 34, 35 includes a connection portion 36 that is firmly connected to the sealing element 29, a hooking portion 37 that is arranged parallel to the connection portion 36, and an intermediate portion 38 that connects the connection portion 36 to the hooking portion 37.

Figure 4:
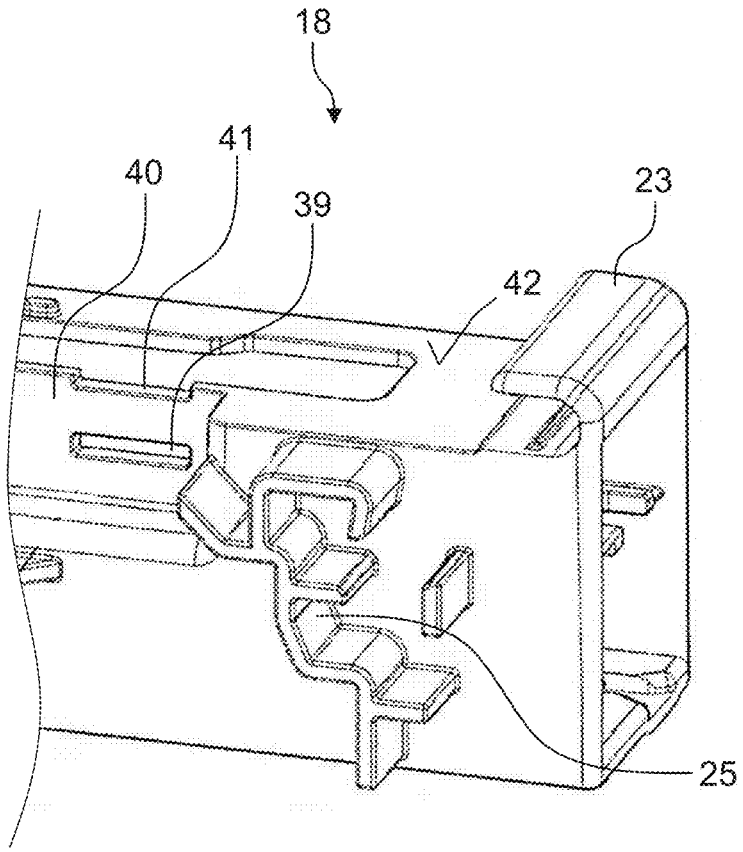
FIG. 4 shows a schematic perspective partial view of an embodiment of a door profile for the door according to FIG. 2.

As shown in FIG. 4, the door profiles 17, 18 each have a receiving portion 39, in particular an aperture or bored hole. Suspended in the receiving portions 39 is the sealing device 28, wherein the hooking portion 37 of the suspension hooks 34, 35 is guided through the receiving portion 39. The receiving portion 39 takes for example the form of an aperture that passes through a side wall 40 of the respective door profile 17, 18. The receiving portion 39 may have any desired geometry. For example, the receiving portion 39 may also be a circular bored hole. Associated with each receiving portion 39 is a groove portion 41, which is arranged at a spacing therefrom. The connection portion 36 of the respective suspension hook 34, 35 comes to lie in the groove portion 41 such that the connection portion 36 does not lie on the upper side of the door profile 17, 18, as a result of which a mechanical load on the first pane 19 is avoided, since this can lie flat on a surface 42 of the respective door profile 17, 18.

Figure 5:
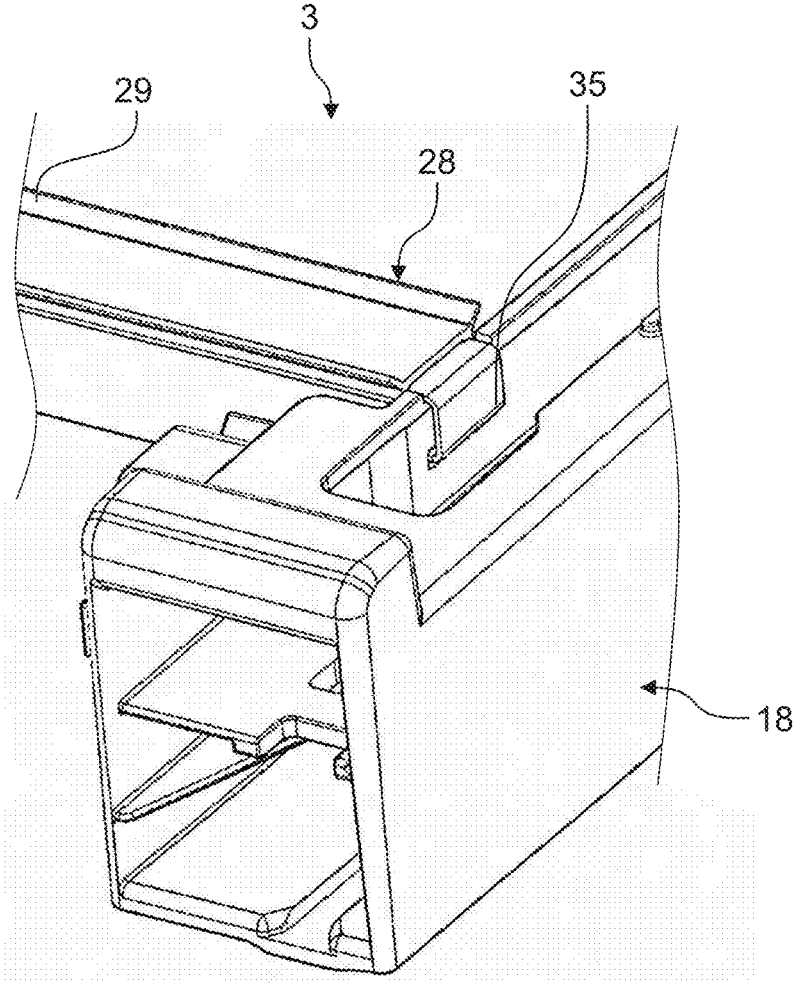
FIG. 5 shows a schematic perspective partial view of the door according to FIG. 2.
Figure 6:
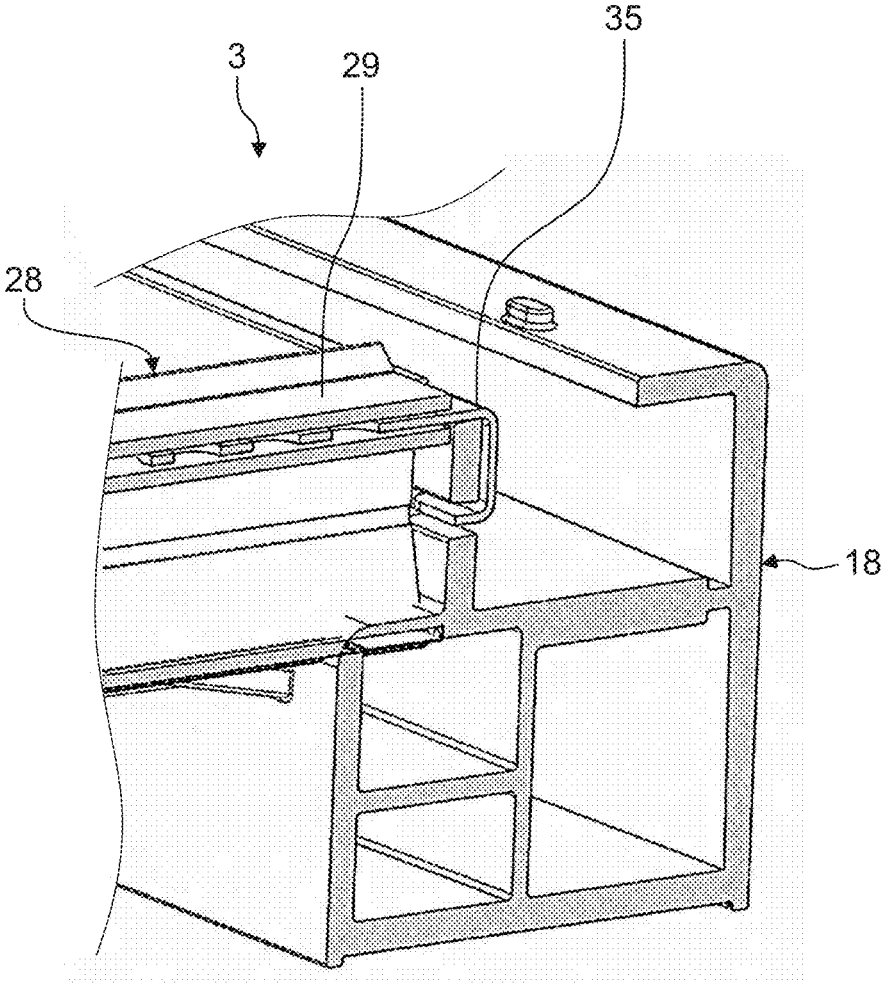
FIG. 6 shows a further schematic partial sectional view of the door according to FIG. 2.
Figure 7:
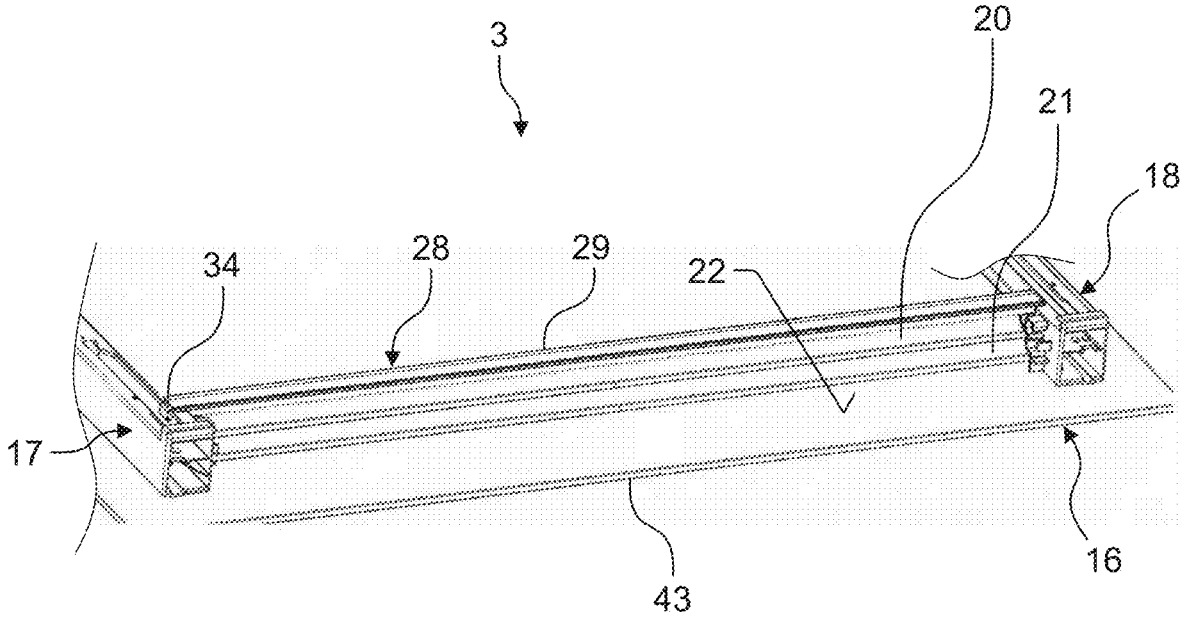
FIG. 7 shows a schematic perspective view of the door according to FIG. 2.

As shown in FIGS. 5 to 7, the suspension hooks 34, 35 are fixed on the respective door profile 17, 18 with the aid of the receiving portion 39 and the groove portion 41. This defines the position of the sealing device 28, and it cannot slip. Because the sealing device 28 is suspended in the door profiles 17, 18, there is no need to fasten the sealing device 28 to one of the panes 19, 20, but rather, independently of the panes 19, 20, it can be suspended from the door profiles 17, 18, which are connected to the fourth pane 16. As a result, the sealing device 28 may span a greater width of the first gap S1 between the panes 19, 20 than if it is fastened to only one of the panes 19, 20. Mounting of the sealing device 28 is unambiguously defined by the receiving portions 39 and the groove portions 41 in the door profiles 17, 18. This means that the sealing device 28 cannot be positioned incorrectly. This allows mounting errors to be avoided. The sealing element 29 may have any desired cross sectional geometry and be of any desired material. For example, the sealing element 29 may also be made from a spring steel and be in one piece with the suspension hooks 34, 35. The door profiles 17, 18 may be made for example from metal or plastics. The suspension hooks 34, 35 may also be made from a plastics material or a silicone material. The sealing device 28 is preferably provided in a lower region or on a lower edge 43 of the door 3. The lower edge 43 is positioned remote from the upper edge 4. The sealing device 28 may also be provided on the upper edge 4.

In the case of a door 3 as described above, sealing of the gaps S1, S2 and/or S3 between the panes 16 and 19 to 21 has a positive effect on energy consumption and thus on the cooking results. In particular, each sealed gap can have a positive effect on energy consumption. Air circulation between certain panes 16 and 19 to 21, for example between the panes 19, 20, is avoided and the door 3 can be ventilated between other panes 16 and 19 to 21, for example between the panes 21, 16. The advantages of the household cooking appliance 1 can be seen in the fact that the sealing device 28 is not mounted directly on one of the panes 16 and 19 to 21 but can be suspended directly in the door profiles 17, 18. This makes it possible to avoid the risk that the suspension hooks 34, 35 may actuate one of the panes 16 and 19 to 21.

The suspension hooks 34, 35 are securely installed in the receiving portions 39 of the door profiles 17, 18, and moreover do not present any risk of injury to customers when dismantling and cleaning the door 3. Providing the receiving portions 39 and the groove portions 41 in the door profiles 17, 18 guarantees the position of the sealing device 28 in a reliable process. Incorrect mounting, for example too high up or too low down on one of the panes 16 and 19 to 21, can be avoided both during manufacture and also by customers when dismantling and cleaning the door 3, and proper functioning can thus also be ensured. The fact of mounting the sealing device 28 on the door profiles 17, 18 moreover makes the sealing device 28 independent of the geometry and size of the panes 16 and 19 to 21, so it can be used universally. Because the suspension hooks 34, 35 come to lie in the groove portions 41 in the door profiles 17, 18, there is no need to provide additional structural space for the suspension hooks 34, 35 between the first pane 19 and the second pane 20. Because of this, the first gap S1 between the panes 19, 20 is made larger, as a result of which improved air circulation is possible. As a result, improved energy efficiency can be achieved, and a temperature of the fourth pane 16 can be reduced because of the insulating effect of the first gap S1.

Although the present invention has been described by way of exemplary embodiments, it may be modified in a wide variety of ways.

The invention claimed is:

1. A household cooking appliance, comprising:

a cooking chamber; and a door for closing the cooking chamber, said door including a first pane, a second pane arranged at a spacing from the first pane, a first door profile, a second door profile arranged at a spacing from the first door profile, and a sealing device arranged between the first pane and the second pane and fastened to the first door profile and the second door profile;

wherein the sealing device has a first suspension hook for suspending the sealing device in the first door profile, and a second suspension hook for suspending the sealing device in the second door profile.

2. The household cooking appliance of claim 1, wherein the sealing device is connected form-fittingly to the first door profile and the second door profile.

3. The household cooking appliance of claim 1, wherein the sealing device is suspended in the first door profile and the second door profile.

4. The household cooking appliance of claim 1, wherein the sealing device is suspended in the first door profile and the second door profile in a pretensioned manner.

5. The household cooking appliance of claim 1, wherein the sealing device has a resiliently deformable sealing element arranged between the first suspension hook and the second suspension hook and firmly connected to the first and second suspension hooks.

6. The household cooking appliance of claim 1, wherein the first suspension hook and the second suspension hook are made from a steel material, and the sealing element is made from a silicone material.

7. The household cooking appliance of claim 1, wherein the sealing element has a sealing lip configured to abut sealingly against one of the first and second panes.

8. The household cooking appliance of claim 1, wherein each of the first and second door profiles includes a receiving portion, in which the sealing device is suspended.

9. The household cooking appliance of claim 8, wherein the receiving portion is an aperture.

10. The household cooking appliance of claim 1, wherein each of the first and second door profiles includes a groove portion in which the first and second suspension hooks are laid, respectively.

* * * * *